United States Patent [19]

Field

[11] Patent Number: 4,913,292

[45] Date of Patent: Apr. 3, 1990

[54] FLIP-TOP DISPENSING CONTAINER

[75] Inventor: David L. Field, Cincinnati, Ohio

[73] Assignee: Westvaco Corporation, New York, N.Y.

[21] Appl. No.: 327,238

[22] Filed: Mar. 22, 1989

[51] Int. Cl.[4] ..... B65D 5/70; B65D 5/74

[52] U.S. Cl. ..... 206/611; 206/621.3; 206/621.6; 206/624; 222/528; 229/125; 229/125.42; 229/160.1; 229/117.22; 229/117.24

[58] Field of Search ..... 206/611, 621, 621.3, 206/621.6, 624; 229/125, 528, 160.1, 125.42; 222/527, 528, 529, 541

[56] References Cited

U.S. PATENT DOCUMENTS

| | | | |
|---|---|---|---|
| 2,361,597 | 10/1944 | Buttery . | |
| 2,421,141 | 4/1947 | Carr | 206/624 |
| 2,757,830 | 8/1956 | Hansen | 222/528 |
| 2,772,823 | 12/1956 | Plamann | 222/527 |
| 2,881,967 | 4/1959 | Ringler | 229/17 |
| 3,302,847 | 2/1967 | Hennessey | 229/17 |
| 3,481,524 | 12/1969 | Ruud et al. | 229/17 |
| 3,764,058 | 10/1973 | Forbes, Jr. | 229/17 |
| 3,981,430 | 9/1976 | Keim | 229/17 |
| 4,726,471 | 2/1988 | Whately et al. | 206/624 |

FOREIGN PATENT DOCUMENTS

| | | | |
|---|---|---|---|
| 864947 | 3/1971 | Canada | 206/621.3 |

*Primary Examiner*—Gary Elkins

[57] ABSTRACT

A flip-top dispensing container for flowable solid materials includes an improved pour spout and a handle element for automatically lifting the flip-top when the container is dispensed. The container is prepared from two cut and scored paperboard blanks to form an outer container portion and an inner insert portion. The flip-top of the container is formed in the top of the outer container portion from portions of three contiguous outer container body panels and a part of the top closure at one end of the container. The improved pour spout is formed from the panels of the inner insert portion by extendable wing elements foldably attached thereto. The wing elements and one panel of the insert are provided with diagonally oriented score lines which enable the wing elements to be folded inwardly to provide improved flow control during dispensing. The handle element is located between the top closure flaps of the outer container so that one end thereof is attached to the flip-top portion of the container. Thus once the container is opened, the flip-top is automatically lifted into its dispensing position when the container is lifted by its handle.

5 Claims, 4 Drawing Sheets

56
55
44
15
14
11

FLIP-TOP DISPENSING CONTAINER

BACKGROUND OF THE INVENTION

The present invention relates to a dispensing container useful for packaging and dispensing both dry and/or greasy flowable products, for example dog food, cat food, cat litter, powdered laundry detergent, or the like. More particularly, the invention relates to an improved structure for a dispensing container which includes a reclosable flip-top opening, an inner pour spout and an outer handle arranged to automatically open the flip-top for dispensing.

Containers for packaging powdered, flaked or granular products whether dry or greasy, usually include provisions for a dispensing opening in either one, or both of the top and upper sides of the container. These dispensing openings are usually formed from scored and perforated panels of the container itself or from added panels. The panels of the container which contain the perforations are essentially the walls of the container, and the perforated portion thereof is usually torn and folded to the side or removed to form the dispensing opening. With dispensing openings of this type, it is virtually impossible to reclose the container in order to protect the contents, and leakage and spoilage generally occurs. Moreover, such containers are generally difficult to dispense with any accuracy because they lack any provision for a pour spout. When pour spouts are considered for such containers, they are generally fashioned from separate components and require considerable expense to add to the container. Examples of containers that may be relevant to the container of the present invention are found in the following U.S. Pat. Nos. 2,361,597; 2,881,967; 3,302,847; 3,481,524; 3,764,058; and 3,981,430.

SUMMARY OF INVENTION

In a preferred embodiment of the present invention, the container is formed from two separate blanks of paperboard, preferably corrugated paperboard which is coated with a moisture and/or grease proof coating. The blanks are cut and scored to form an outer container portion and an inner insert portion. The blank for the outer container portion comprises a plurality of side and end wall panels with top and bottom closure flaps attached to the ends thereof. The flip-top part of the container is formed in the blank for the outer container portion along with a provision for releasing the flip-top for dispensing, and a handle element is arranged in the top of the outer container to automatically lift the flip-top when the container is lifted by the handle. The pour spout part of the container is formed in the blank for the inner insert portion of the container by foldably attached wing elements included along the top edge of the inner blank. These components when combined produce a novel flip-top dispensing container construction unlike any heretofore disclosed in the prior art.

Accordingly, it is an object of the present invention to provide a dispensing container with a reclosable flip-top opening.

It is another object of the present invention to provide a convenient tear strip for releasing the flip-top opening of the container.

Another object is to provide in such a container a unique pour spout feature formed from a separate blank of container material comprising an insert for the container.

Finally, it is an object of the present invention to provide a dispensing container of the type disclosed herein with an integral handle at the top thereof arranged to automatically open the flip-top when the container is lifted by its handle.

DETAILED DESCRIPTION

In accordance with one aspect of the present invention, a flip-top dispensing container is formed from two separate blanks of foldable material such as corrugated paperboard. The two blanks comprise an outer container portion having opposed end and side walls, and foldable flaps at each end of the end and side walls to form top and bottom closures, and an inner container portion having two opposed side walls connected to an intermediate end wall. The outer container blank is provided with a tear strip that is used to release the flip-top part of the container for dispensing and a handle element is built into the top closure flaps so as to automatically open the flip-top for dispensing. Meanwhile, the inner container blank is provided with wing elements at the dispensing end which may be folded inwardly prior to use to provide a convenient pour spout during dispensing. When the container is set up, the inner portion may be simply inserted into the formed outer container or glued to the inside surfaces of the outer container walls as desired. In addition, the inside surfaces of the inner portion and the outer container may be coated with a moisture and/or grease resistant coating depending upon the product to be packaged in the container.

Figure 1:
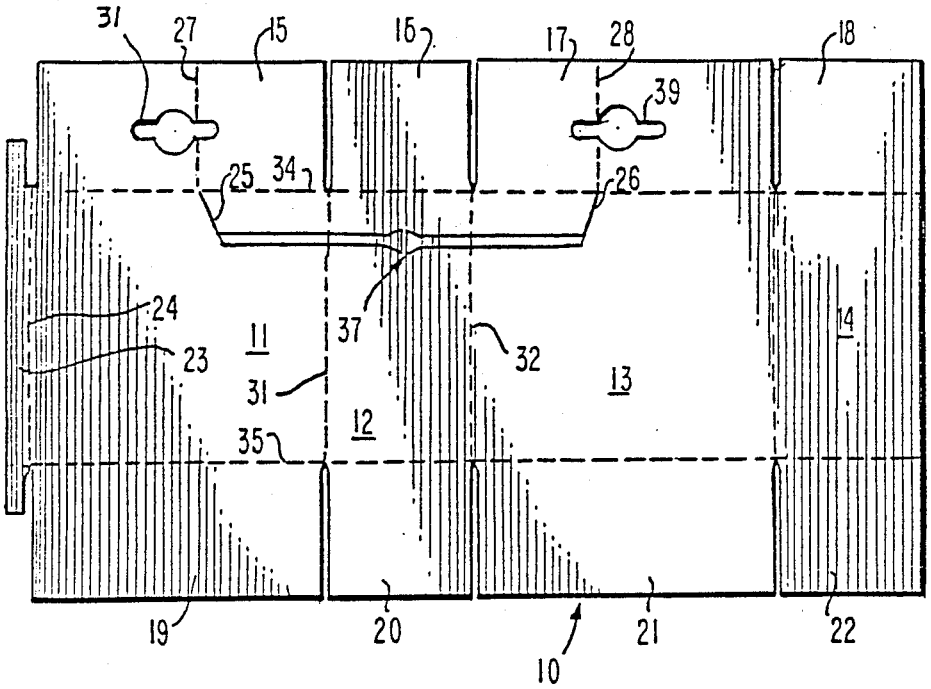
FIG. 1 is a plan view of a flat blank for forming the outer container portion of the present invention.

Referring first to FIG. 1 of the drawing, the outer container blank 10 comprises a plurality of panels 11, 12, 13 and 14 separated by fold lines 31 32, and 33, which in the formed condition of the container make up the end and side walls thereof. At the upper ends of the end and side wall panels are top closure flaps 15, 16, 17 and 18 foldably attached thereto along a score line 34, and at the lower ends of the end and side wall panels are bottom closure flaps 19, 20, 21 and 22 foldably attached thereto along a score line 35. A tear strip 36 is provided in the blank 10 so as to extend at least across one end wall 12 and into the adjacent side walls 11 and 13 a sufficient distance to form the flip-top portion of the container. Access to the tear strip 36 is provided at 37 in end wall 12 by a pair of tab elements. In addition, the top closure flaps 15 and 17 foldably attached to side walls 11 and 13 are each provided with a cut out 38, 39 wherein there is mounted a handle element such as the "Wilton" handle during construction of the outer container. Meanwhile, a glue flap 23 is foldably attached to one side wall 11 along a fold line 24 for securing the side and end walls together. The flip-top feature of the container of the present invention is formed in the outer container blank 10 by a pair of cut-score lines 25, 26 which extend diagonally in side walls 11 and 13 from the tear line 36 to intersect fold lines 27, 28 in the top closure flaps 15 and 17. Note that the score lines 27, 28 are offset from the center of the handle cut outs 38, 39 in the top closure flaps 15 and 17. This offset is designed to facilitate the unique automatic opening mechanism for the flip-top when the handle is lifted after the flip-top has been released from the outer container structure.

Figure 2:
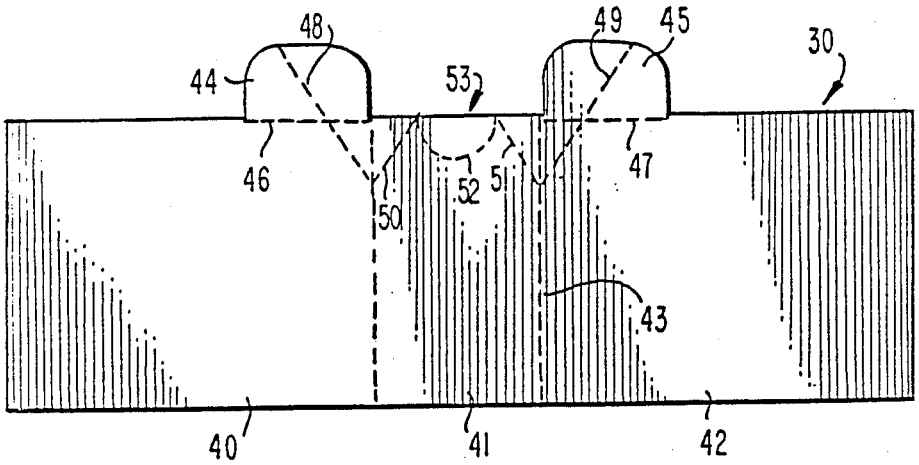
FIG. 2 is a plan view of a flat blank for forming the inner insert portion of the present invention.

Referring now to FIG. 2 of the drawings, the blank structure 30 for the insert portion of the container is disclosed as comprising panels 40, 41 and 42 foldably connected along score lines 39 and 43. The panels 40, 41 and 42 are designed to coincide in size substantially with panels 11, 12 and 13 of the outer container blank 10. When fitted inside of the outer container, the panels 40, 41 and 42 are assured of a snug fit with the inner surfaces of panels 11, 12 and 13. Each of the panels 40 and 42 are further provided with wing elements 44, 45 foldably attached thereto along score lines 46, 47. The width of the wing elements 44, 45 is designed to correspond essentially with the size of the flip-top as measured along the top flaps 15 and 17 of the outer blank structure 10 from the fold lines 27, 28 therein to the closest ends of the flaps. Meanwhile, the height of the wing elements 44, 45 above the score lines 46, 47 is designed to be sufficient to fit beneath the flip-top of the outer container when it is opened to its substantially fully open condition, so as to retain it in the open condition, while simultaneously providing the unique pour spout feature of the present invention. For this latter purpose, the wing elements 44, 45 are each provided with diagonally oriented score lines 48, 49 to match the corresponding score lines 50, 51 in the panel 41 of the inner blank structure 30. The score lines 48, 50 intersect one another along the score line 39 between panels 40 and 41 below the top of the panels 40, 41, 42 at a point that is substantially equal to the height of the flip-top provided in the outer container. Score lines 49 and 51 intersect one another at substantially the same point along score line 43, and each of the score lines 48, 49, 50 and 51 deviate from the vertical at an angle of between 30–45 degrees depending upon the size of the outer container. Meanwhile panel 41 is provided with a substantially U-shaped cut out 53 along its upper edge defined by the arcuate cut line 52 between score lines 50, 51. The cut out 53 is provided as a part of the pour spout structure formed by the wing elements 44 and 45 of the inner blank structure 30.

Figure 3:
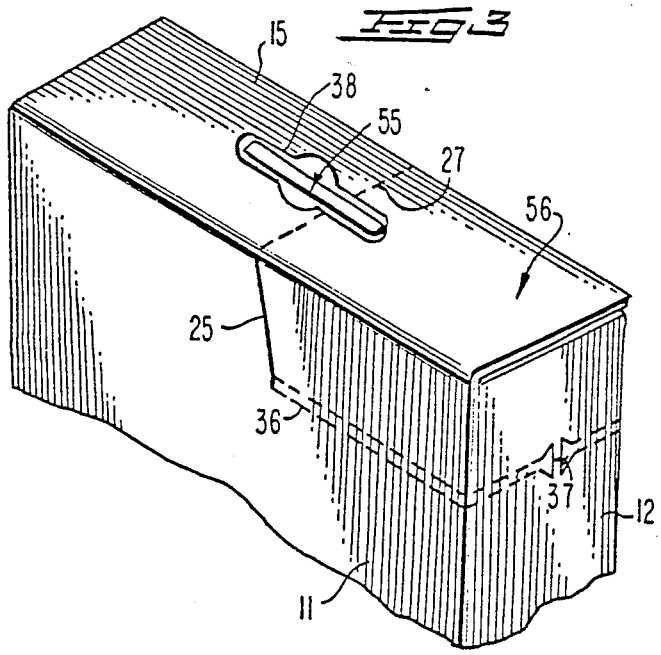
FIG. 3 is a partial perspective view showing the top of the flip-top dispensing container of the present invention.
Figure 4:
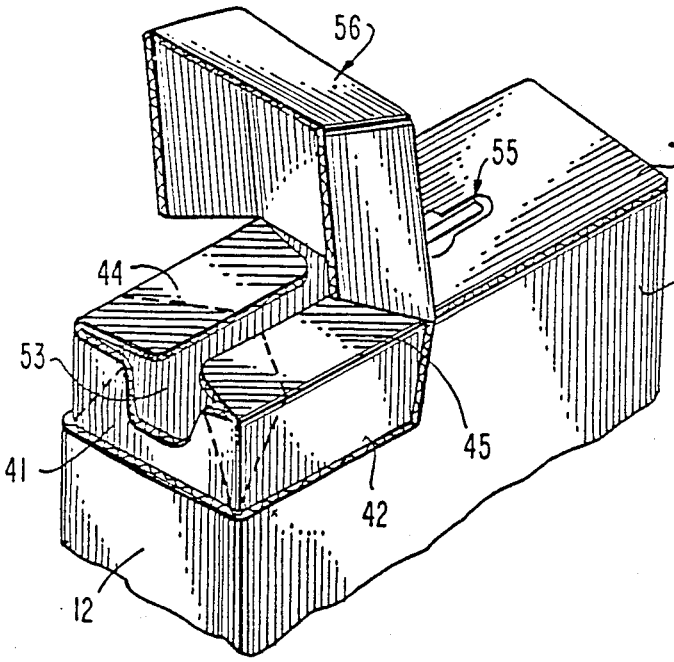
FIG. 4 is a partial perspective view of the container of the present invention opened in preparation for dispensing.
Figure 5:
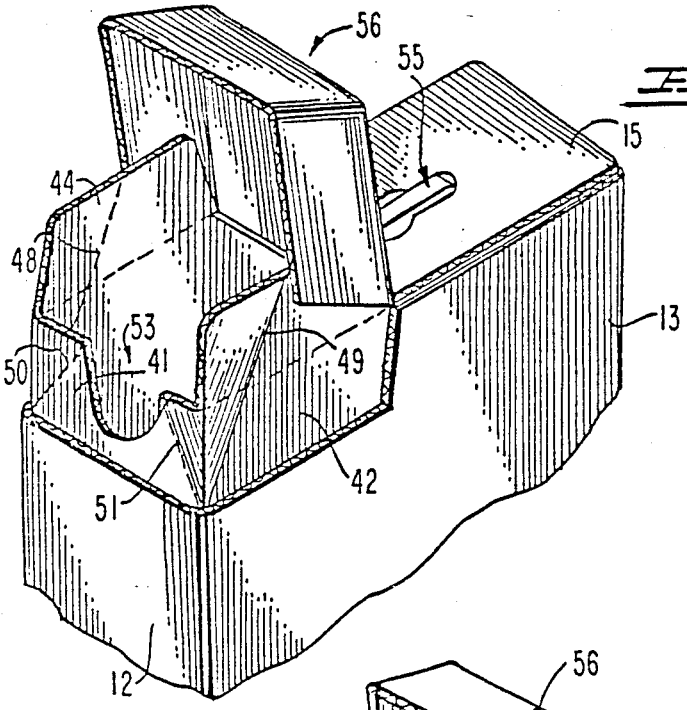
FIG. 5 is a view similar to FIG. 4 showing the wing elements of the inner insert portion of the container folded upwardly to retain the flip-top in an open condition.
Figure 6:
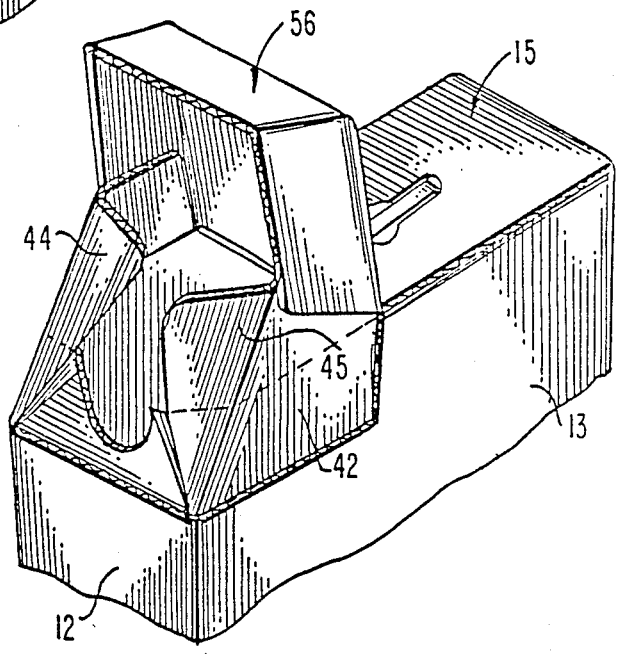
FIG. 6 is a view similar to FIG. 5 showing the wing elements folded inwardly to create the unique pour spout of the present invention; and, FIG. 7 is a partial perspective view of the container of the invention, taken from the rear, to illustrate the location of the lifting handle and its automatic flip-top lifting feature.
Figure 7:
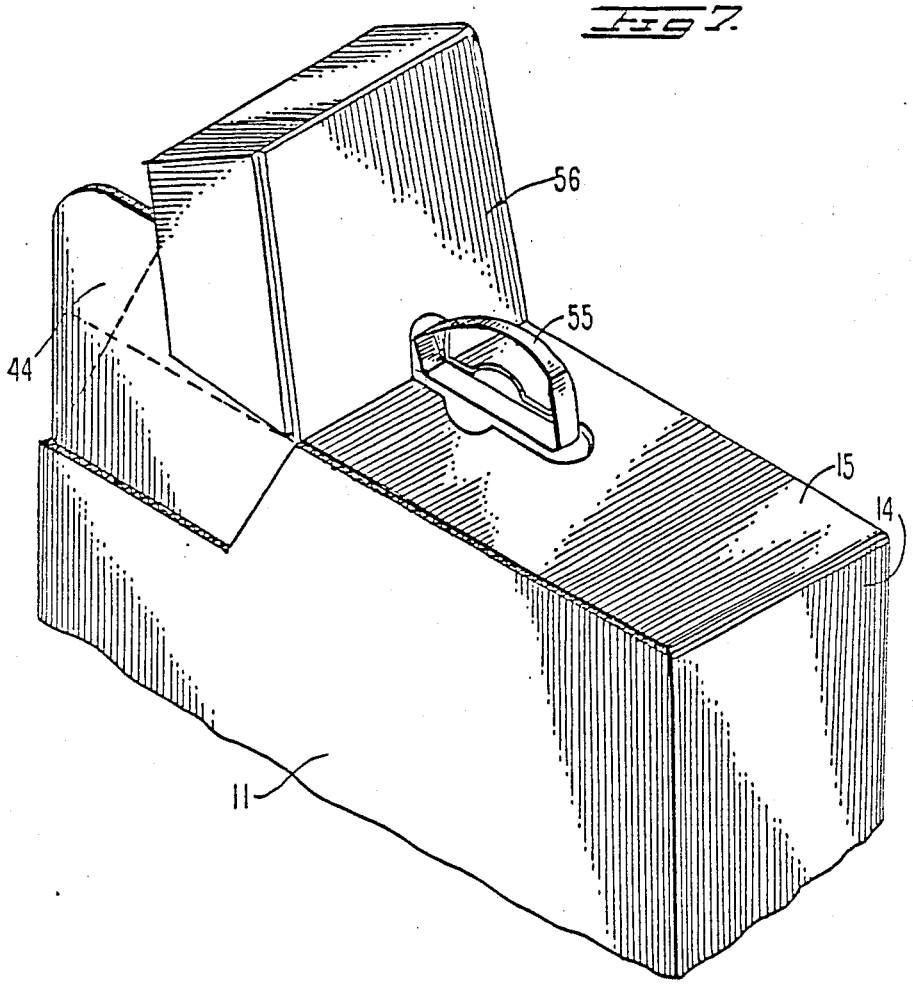

FIG. 3 illustrates the container formed by the two blanks shown in FIGS. 1 and 2. The top closure flap 15 of the outer container includes a cut out 38 into which there is mounted a handle element 55, preferably a "Wilton" handle. These handles are known in the industry and have been used in the past with other corrugated containers. The flip-top portion 56 of the container is formed by score lines 27 and 28 in top closure flaps 15 and 17, cut line 25 (with a similar cut line 26 on the other side of the container), and the tear strip 36. Tear strip 36 may be constructed in any desired manner, but preferably includes a plastic tear tape fixed to the inside surface of the blank structure 10 for the outer container. The tear strip is provided with starting tabs 37 located on the front panel 12 of the outer container and continues along side wall 11 (shown) and 13 (not shown) to intersect cut lines 25, 26. When the tear strip portions are removed, as shown in FIG. 4, the flip-top 56 can be lifted upwardly manually or simply by picking up the container by the handle 55. In FIG. 4, lifting the flip-top 56 exposes the upper part of the insert portion of the container formed by blank 30. Note in this view that the wing elements 44, 45 of the insert are folded downwardly to protect the contents of the container. When it is desired to dispense the contents of the container, the wing elements 44, 45 are first folded upwardly as shown in FIG. 5. In this position, the wing elements effectively retain the flip-top lid 56 in its open condition for dispensing. However, before dispensing, the unique pour spout feature of the present invention is prepared by folding the corners of the insert panel 41 and the wing elements 44, 45 inwardly along the score lines 48, 50 and 49, 51, to provide a restricted throat area for improved flow control without spilling during dispensing. The pour spout in its preferred mode for dispensing is illustrated in FIG. 6. In FIG. 7, the relationship between the lifting handle 55 and the flip-top 56 is shown. With one end of the lifting handle 55 attached to the flip-top 56, the flip-top is automatically opened when the container is picked up by the handle for dispensing.

While certain preferred features of the invention have been pointed out in detail in the foregoing specification, it will be understood that various omissions, substitutions and changes in the form and detail of the container may be made by one skilled in the art without departing from the spirit of the invention as defined in the appended claims.

What is claimed is:

1. A dispensing container having a hinged, flip-top lid comprising:

an outer container portion comprising a plurality of wall panels foldably connected together along parallel fold lines and including at least one glue flap foldably attached to one wall panel and adhered to another wall panel;

(b) an inner container portion comprising a plurality of wall panels foldably connected together along parallel fold lines and arranged to fit snugly within said outer container portion:

(c) top and bottom closure flaps foldably attached to the ends of said outer container wall panels for forming top and bottom closures for said outer container;

(d) a hinged flip-top lid formed at the top end of said outer container, said lid comprising a top panel consisting of a part of the top closure of said outer container hingedly connected to the remaining part of said top closure, and three depending wall panels formed from contiguous parts of three connected walls of said outer container, said lid wall panels being detachable from the walls of said outer container along a tear line located in said outer container walls below the top closure of said outer container and a pair of cut lines located in two opposed walls of said three connected walls, said tear line and cut lines intersecting one another at corresponding points in the outer container side walls; and, (e) a pour spout formed by contiguous parts of three connected walls of said inner container portion located at the top-end of said inner container portion beneath said flip-top lid.

2. The container of claim 1 wherein the inner container portion includes a pair of wing elements foldably attached to the upper edges of two opposed walls of said inner container located beneath said flip-top lid, said wing elements being adapted to support the flip-top lid in its opened condition when folded into their upright condition above the upper edges of the two opposed walls.

3. The container of claim 2 wherein the pour spout in said inner container portion is formed by a portion of said wing elements, the two opposed walls of said inner container portion, and a third end wall connected between the two opposed side walls of said inner container portion which are folded inwardly of said inner container portion along diagonally oriented score lines.

4. The container of claim 3 wherein the outer container portion includes a lifting handle incorporated into the top closure flaps of said outer container.

5. The container of claim 4 wherein the lifting handle is arranged in said top closure flaps so that one end thereof is attached to the top panel portion of said flip-top and the other end is attached to the remaining part of said top closure whereby said flip-top lid is automatically opened when the container is lifted by its lifting handle.

* * * * *